US008239128B2

(12) United States Patent
Everett et al.

(10) Patent No.: US 8,239,128 B2
(45) Date of Patent: Aug. 7, 2012

(54) ELECTRIC CABLE MANAGEMENT FOR A MOBILE MACHINE

(75) Inventors: Bryan James Everett, Peoria, IL (US); Michael Siemer, Oxley (AU); Craig Lawrence Koehrsen, East Peoria, IL (US); Eric Alan Moughler, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/957,060

(22) Filed: Nov. 30, 2010

(65) Prior Publication Data

US 2012/0136564 A1 May 31, 2012

(51) Int. Cl.

| | |
|---|---|
| ***G06F 17/10*** | (2006.01) |
| ***G06G 7/78*** | (2006.01) |
| ***G06G 1/16*** | (2006.01) |

(52) U.S. Cl. ..... 701/301

(58) Field of Classification Search ..... 701/301
See application file for complete search history.

(56) References Cited

U.S. PATENT DOCUMENTS

| | | | | |
|---|---|---|---|---|
| 7,793,442 | B2 | 9/2010 | Koch et al. | |
| 2009/0082949 | A1 * | 3/2009 | Petrie et al. | 701/119 |
| 2009/0265962 | A1 * | 10/2009 | Koch et al. | 37/413 |
| 2009/0266664 | A1 * | 10/2009 | Everett et al. | 191/12 C |
| 2011/0153190 | A1 * | 6/2011 | Rolinski et al. | 701/201 |

* cited by examiner

*Primary Examiner* — Mary Cheung
*Assistant Examiner* — Michael D Lang
(74) *Attorney, Agent, or Firm* — Finnegan, Henderson, Farabow, Garrett & Dunner LLP

(57) ABSTRACT

A method of managing movement of an electric cable that is configured to provide power to a mobile machine. The method includes determining an initial boundary of an isolation zone in which the cable lies, for a first location of the machine. The initial boundary is divided into a first static boundary and a first dynamic boundary. The first static boundary surrounds a static isolation sub-zone of the isolation zone, and the first dynamic boundary surrounds a dynamic isolation sub-zone of the isolation zone. A second dynamic boundary surrounding the dynamic isolation sub-zone is determined, based on a second location of the machine when the machine moves from the first location to the second location, such that the cable lies within the second dynamic boundary. The first static boundary is maintained when the machine is in the second location.

20 Claims, 3 Drawing Sheets

ELECTRIC CABLE MANAGEMENT FOR A MOBILE MACHINE

TECHNICAL FIELD

The present disclosure is directed to electric cable management for a mobile machine, and more particularly to electric cable management between movements of the machine.

BACKGROUND

A moving or mobile machine, such as an earthmoving machine, an excavation-type machine, a mining machine, or the like, may be employed for mining or another earthmoving operation. The machine may employ large earthmoving, excavating, drilling, or mining equipment, such as an electric mining shovel, configured to dig and/or load earthen material from a worksite, such as an open-pit mine, to one or more large off-road haulage units, such as off-highway trucks that may be driven by a driver or autonomously or semi-autonomously controlled. The shovel may be electrically powered and may receive power from a high-voltage cable that is tethered to the rear of the machine. The electric cable may lie across the ground of the worksite during operation of the shovel. When the shovel swings between a digging location and a loading location where the shovel loads a mobile vehicle (such as an off-highway truck), the cable may be dragged across the ground and the location of the cable may change relative to the ground. Similarly, the cable may move when the shovel moves, such as when the shovel moves from one digging location to a subsequent digging location.

Off-highway trucks may navigate to and from the location of the shovel in order to transport the earthen material from the worksite. A driver of the off-highway truck must avoid contact with the electric cable so as to prevent damage to both the electric cable and the truck. For similar reasons, an autonomous truck must avoid contact with the electric cable. However, mobility and navigation around the electric cable may be difficult because the driver of the truck may be unable to see the ground, and thus may be unable to locate the electric cable near the truck. In the case of the autonomous truck, the location of the cable must be determined since there is no driver.

FIGS. 1A and 1B show examples of related systems in which the location of the electric cable is managed. As shown in FIG. 1A, when electric mining shovel 110 is located at digging location A, the boundary of isolation zone 120 in which electric cable 130 lies on the ground is determined. Specifically, the boundary of isolation zone 120 extends from adjacent the high-voltage power source 140, to which one end of electric cable 130 is connected, to shovel 110, to which the other end of electric cable 130 is connected. The boundary of isolation zone 120 may be marked with visual markers (e.g., safety cones, fencing, etc.), and/or the coordinate locations of the boundary of isolation zone 120 may be determined (e.g., with global position system coordinates, sensors, etc.), so that a driver-operated and/or autonomous vehicle (e.g., a truck loaded with earthen material removed by shovel 110) may be prevented from driving over electric cable 130.

As shown in FIG. 1B, when electric mining shovel 110 is moved to another, adjacent digging location, such as from digging location A to digging location B, the boundary of a different isolation zone 140, in which electric cable 130 now lies on the ground, must be determined. Thus, every time shovel 110 moves to a different digging location, the boundary of another isolation zone in which electric cable 130 lies on the ground must be determined. This boundary determination is a time-consuming and labor intensive procedure, and operation of driver-operated and autonomous vehicles around shovel 110 must be halted until the boundary of the isolation zone is determined, to ensure that electric cable 130 is not run over by any of the vehicles operating in the vicinity of shovel 110.

SUMMARY

One disclosed embodiment relates to a method of managing movement of an electric cable that is configured to provide power to a mobile machine. The method includes determining an initial boundary of an isolation zone in which the cable lies, for a first location of the machine. The initial boundary is divided into a first static boundary and a first dynamic boundary. The first static boundary surrounds a static isolation sub-zone of the isolation zone, and the first dynamic boundary surrounds a dynamic isolation sub-zone of the isolation zone. A second dynamic boundary surrounding the dynamic isolation sub-zone is determined, based on a second location of the machine when the machine moves from the first location to the second location, such that the cable lies within the second dynamic boundary. The first static boundary is maintained when the machine is in the second location.

Another embodiment relates to a method of managing movement of an electric cable that is configured to provide power to a mobile machine. A boundary of a power-side isolation zone in which the cable extends from a power source to a first pole, is determined. A boundary of a machine-side isolation zone in which the cable extends from a second pole to the machine, is determined. A location of an anchor line that divides the boundary of the machine-side isolation zone into a first static boundary and a first dynamic boundary, is determined. The first static boundary surrounds a static isolation sub-zone of the isolation zone, and the first dynamic boundary surrounds a dynamic isolation sub-zone of the isolation zone. A second dynamic boundary surrounding the dynamic isolation sub-zone is determined, based on the location on the anchor line and on a second location of the machine when the machine moves to the second location, such that the cable lies within the second dynamic boundary. The first static boundary is maintained when the machine is in the second location.

A further disclosed embodiment relates to a tangible, computer-readable storage medium storing a program that, when executed by a processor of a computer, performs a method of managing movement of an electric cable that is configured to provide power to a mobile machine. The method includes determining an initial boundary of an isolation zone in which the cable lies, for a first location of the machine. A location of an anchor line that divides the initial boundary into a first static boundary and a first dynamic boundary is determined. The first static boundary surrounds a static isolation sub-zone of the isolation zone, and the first dynamic boundary surrounds a dynamic isolation sub-zone of the isolation zone. A second dynamic boundary surrounding the dynamic isolation sub-zone is determined, based on the location on the anchor line and on a second location of the machine when the machine moves from the first location to the second location, such that the cable lies within the second dynamic boundary. The first static boundary is maintained when the machine is in the second location.

DETAILED DESCRIPTION

Figure 1A:
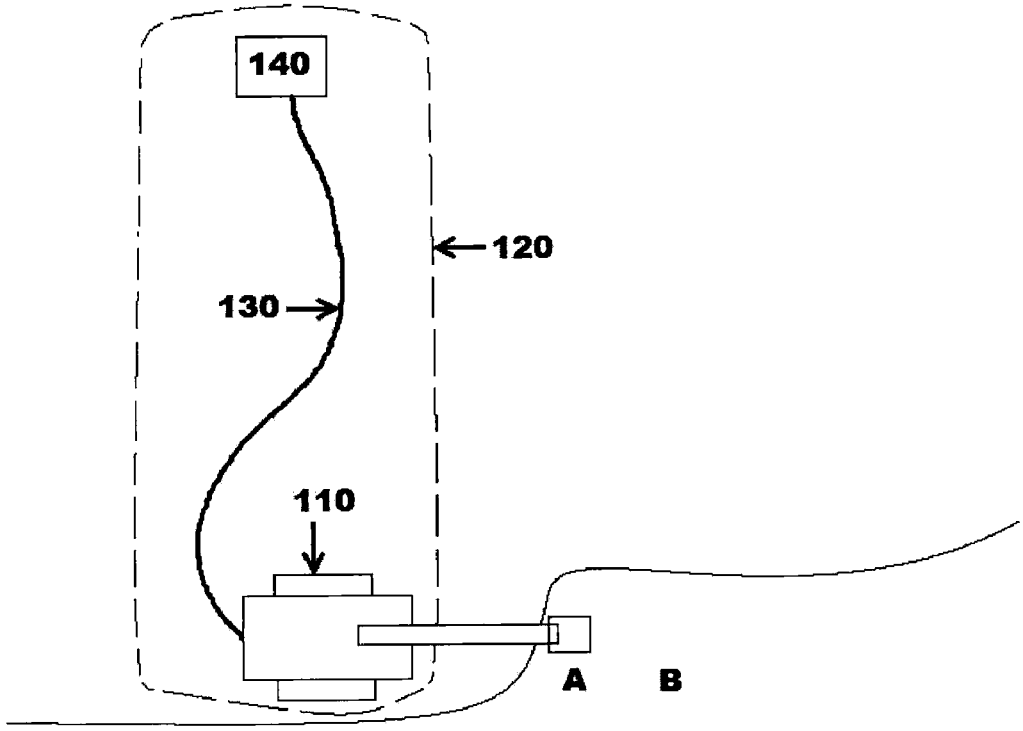
FIG. 1A is a diagrammatic illustration of electric cable location management when the electric shovel is in position A.
Figure 1B:
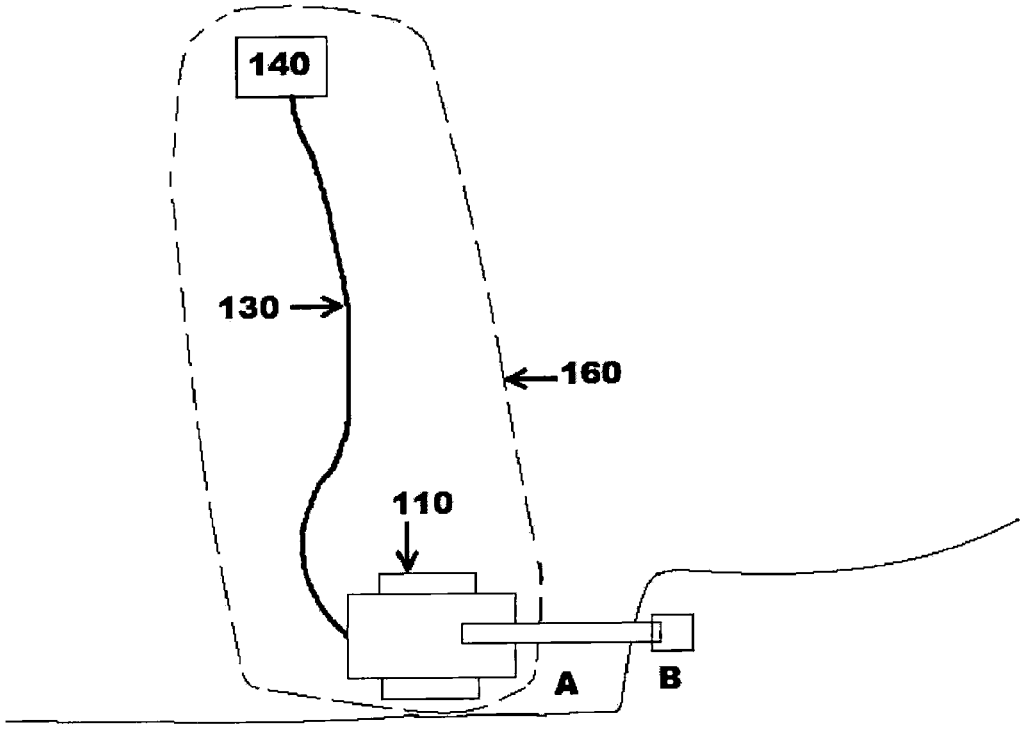
FIG. 1B is a diagrammatic illustration of electric cable location management when the electric shovel has moved to position B.
Figure 2A:
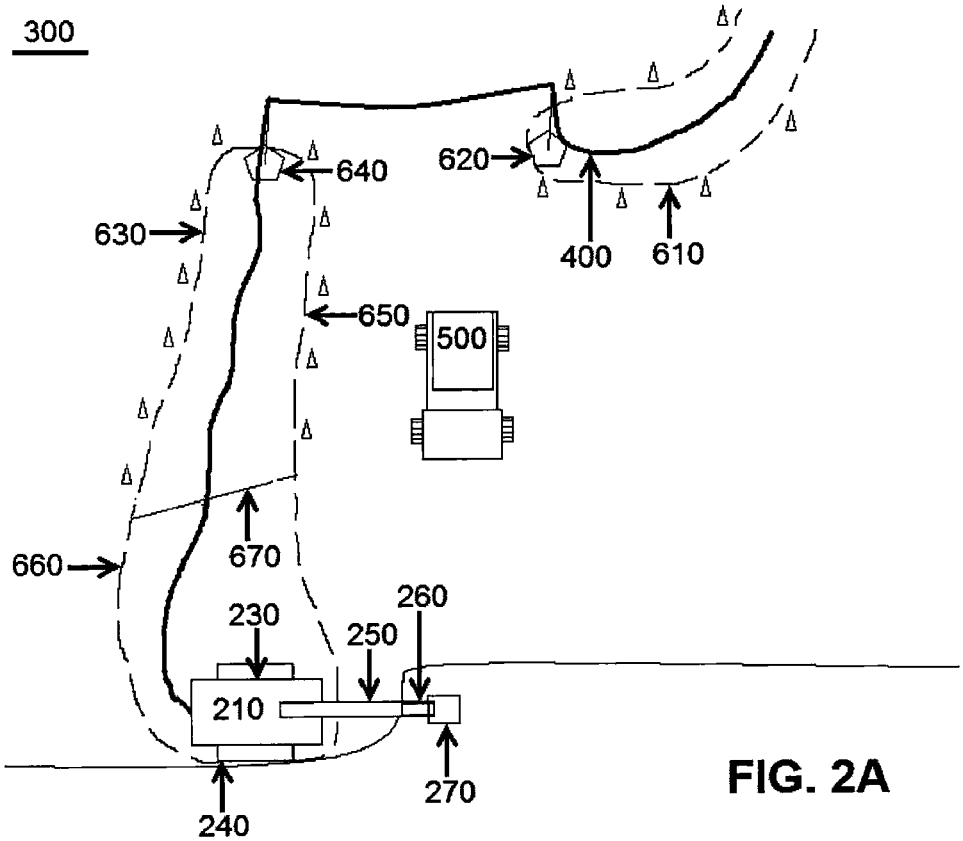
FIG. 2A is a diagrammatic illustration of electric cable location management when the mobile machine is in a first location, in accordance with the disclosure.
Figure 2B:
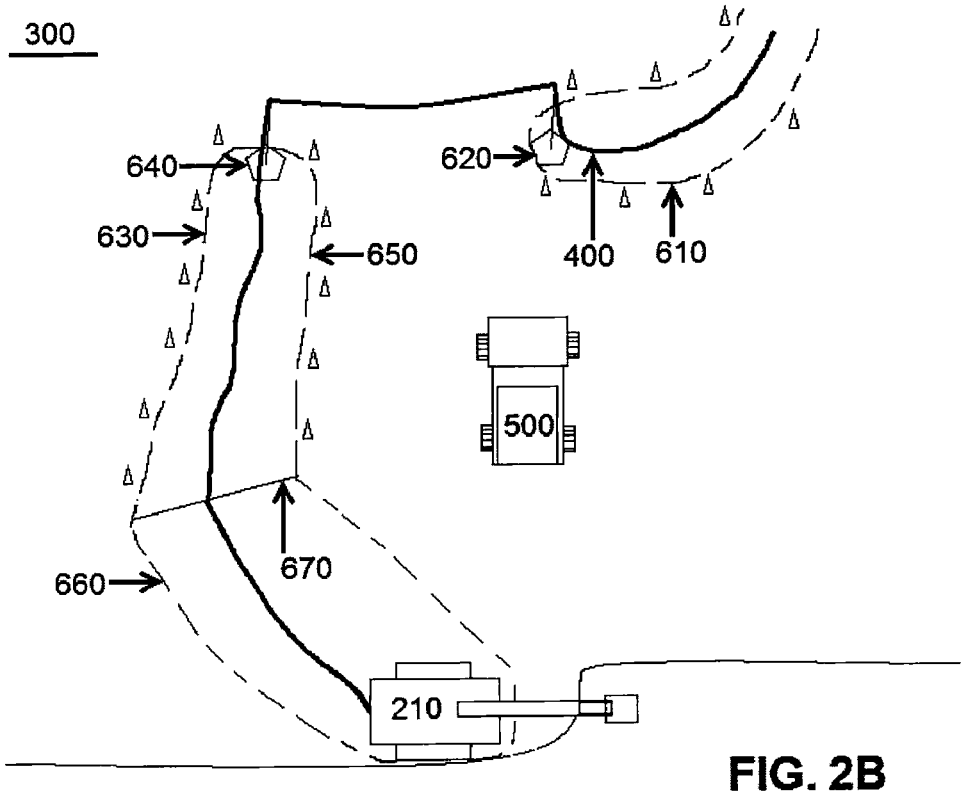
FIG. 2B is a diagrammatic illustration of electric cable location management when the mobile machine has moved from the first location of FIG. 2A to a second location, in accordance with the disclosure.
Figure 2C:
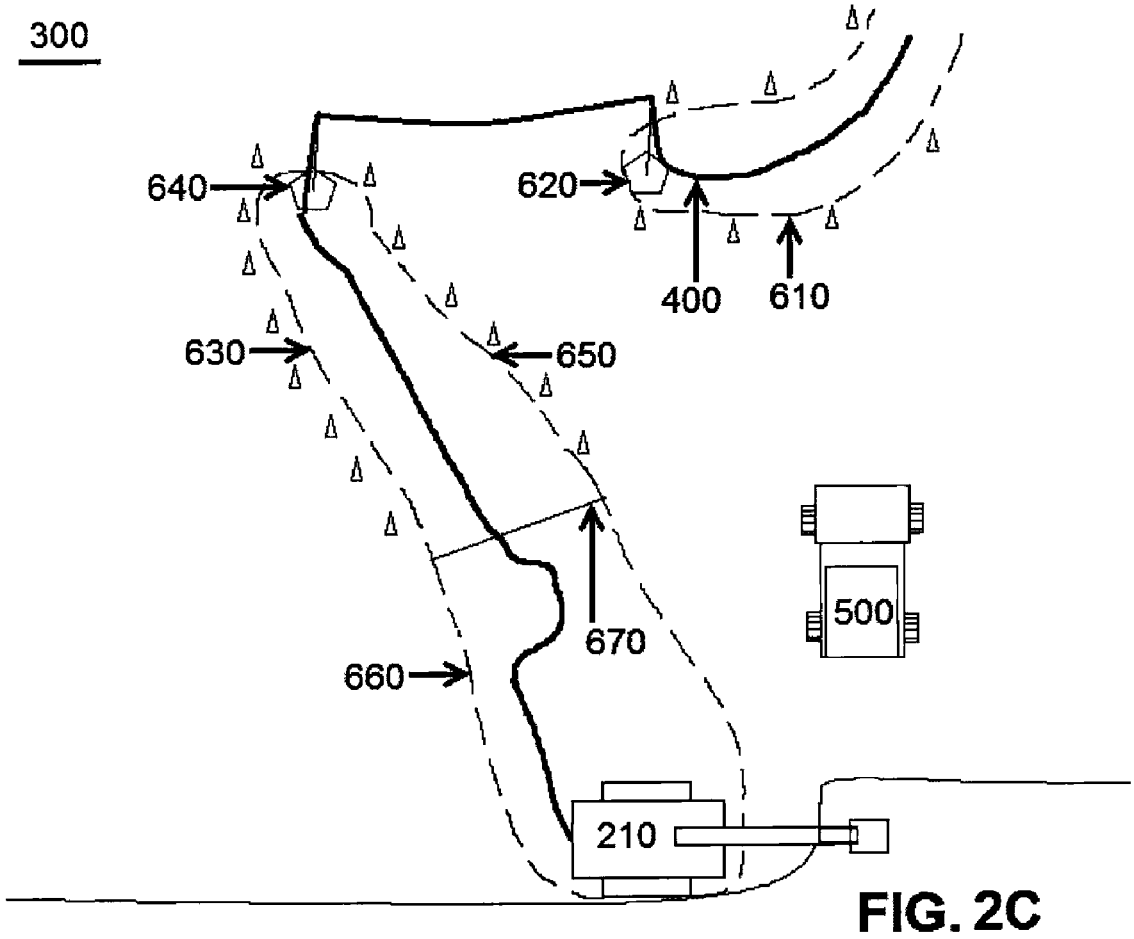
FIG. 2C is a diagrammatic illustration of electric cable location management when the mobile machine has moved from the second location of FIG. 2B to a third location, in accordance with the disclosure.

FIGS. 2A-2C are diagrammatic illustrations of electric cable location management when a moving or mobile machine 210 operating on a worksite 300 moves among first, second, and third locations on worksite 300. Machine 210 may be any type of machine capable of excavating earth, such as an excavator machine, a drilling machine, an electric mining shovel machine, or the like. As shown in the figures, machine 210 may be self-propelled and include a rotatable car body 230 connected to an undercarriage 240. Machine 210 may also include a boom 250, a stick 260, and an earthmoving tool 270. Boom 250 may be pivotally mounted on machine 210 by a boom pivot pin. Stick 260 may be pivotally connected to the free end of boom 250 at a stick pivot pin. Earthmoving tool 270 may be a power shovel, a bucket, or the like, and may be pivotally attached to stick 260 at a bucket pivot pin and configured to dig, scoop, and/or load material, such as but not limited to ore, coal, or other minerals. A cable 400, e.g., a set of high-voltage cables, may be engaged with and tethered from one or more large electric motors (not shown) on the rear of machine 210. Cable 400 may be configured to provide electricity from a central high-voltage power source (not shown) to machine 210 so as to power the operation of machine 210 and earthmoving tool 270. Machine 210 may be configured to travel along worksite 300, such as, for example, an open-pit mine. Car body 230 may rotate so that earthmoving tool 270 may excavate and load material from various locations of worksite 300 along the path of rotation. Earthmoving tool 270 may be configured to unload material to worksite equipment, such as a vehicle 500, so that vehicle 500 may transport material from worksite 300.

FIG. 2A shows machine 210 at a first digging or working location on worksite 300. As shown in the figure, worksite 300 may include one or more isolation zones or areas in which cable 400 lies on the ground. Vehicles, such as vehicle 500, may be kept out of the isolation zones, so that vehicle 500 does not run over cable 400. Running over cable 400 may result in damage to cable 400 and/or vehicle 500. Once boundaries are determined for the isolation zones, the boundaries may be marked by visual markers (e.g., safety cones, fencing, etc.) in order to provide one or more visual cues to the driver of vehicle 500 to stay outside of the isolation zones. Alternately, or in conjunction with the visual markers, coordinate locations of the boundaries defining the isolation zones may be determined. These coordinate locations may be provided to driver-controlled and/or autonomous vehicles. When the driver-controlled vehicle drives into the isolation zone, an audible, a visual, or another type of alarm may be activated, alerting the driver that the vehicle is within the isolation zone. Or, the autonomous vehicle may receive these coordinate locations and be prohibited from driving into the isolation zones.

The boundary of a first isolation zone (power-side isolation zone) 610 may encompass cable 400 where it lies on the ground between a power source and a support pole. Specifically, the boundary of first zone 610 may extend from the high-voltage power source (not shown), to which one end of cable 400 is connected, to a nonshovel-side pole 620 that supports a portion of cable 400 off the ground. Vehicles, such as vehicle 500, should remain outside first zone 610 to prevent damage to cable 400 and/or vehicle 500. First zone 610 may be provided as a static isolation zone, since movement of machine 210 between different digging or working positions on worksite 300 does not result in a change of location of cable 400 within first zone 610 and does not result in cable 400 being moved outside of the original boundary of first zone 610. Thus, the boundary of first zone 610 does not change as a result of movement of machine 210 between different digging locations.

The boundary of second isolation zone 630 (machine-side isolation zone) may encompass cable 400 where it lies on the ground between another support pole and machine 210. Specifically, the boundary of second zone 630 may extend from machine 210, to which the other end of electric cable 400 is connected, to a shovel-side pole 640 that supports another portion of cable 400 off the ground. Similar to first zone 610, vehicles including vehicle 500 should remain outside of the boundary of second zone 630 to prevent damage to cable 400 and/or vehicle 500. Second zone 630 may be provided as a dynamic isolation zone, since movement of machine 210 to another digging location on worksite 300 does, in fact, result in a change of location of cable 400 within at least some portion of second zone 630, as well as result in cable 400 moving outside of at least a portion of the original boundary of second zone 630. Thus, to at least some extent, the boundary of second zone 630 must change as a result of movement of machine 210 between digging locations.

Second zone 630 is divided into sub-zone 650 and sub-zone 660. The boundary of sub-zone 650 may encompass cable 400 where it lies on the ground from shovel-side pole 640 to a location where movement of machine 210 does not result in movement of cable 400 outside of sub-zone 650. In other words, sub-zone 650 may be provided as a static isolation zone, since movement of machine 210 to another digging location on worksite 300 does not result in movement of cable 400 outside of the original boundary of second zone 630 or outside of the original boundary of sub-zone 650. As a result, during movement of machine 210 between digging locations on worksite 300, the boundary of sub-zone 650 does not change, and does not need to be redetermined.

As shown in the figures, sub-zone 650 may extend from shovel-side pole 640 to an anchor line 670, which is an imaginary line on worksite 300. Anchor line 670 may be defined by two anchor points, a line through which forms an end of sub-zone 650 farthest from shovel-side pole 640. These two points, and thus the location of anchor line 670, may be chosen such that an area of sub-zone 650, which is a static isolation zone, is maximized, while the area of sub-zone 660 that is a dynamic isolation zone (as described in more detail below) is minimized.

The boundary of sub-zone 660 may encompass cable 400 where it lies on the ground from machine 210 to the location where movement of machine 210 to another digging location (such as a relatively near digging location) does, in fact, result in movement of cable 400 outside of the original boundary of sub-zone 660. In other words, sub-zone 660 may be provided as a dynamic isolation zone, since movement of machine 210 to another, adjacent digging location on worksite 300 does result in cable 400 moving outside of the original boundary of sub-zone 660, and therefore the boundary of sub-zone 660 does change as a result of movement of machine 210 between adjacent digging locations.

In order to permit vehicles, such as vehicle 500, to travel between first and second isolation zones 610 and 630, the first and second isolation zones 610 and 630 may be separated a sufficient distance from one another. Thus, nonshovel-side pole 620 and shovel-side pole 640, each of which supports cable 400 off of the ground, may be disposed far enough apart to permit vehicles, such as vehicle 500, to pass therebetween.

FIG. 2B shows machine 210 having moved from the first digging location to the second digging or working location on worksite 300. Even as a result of movement of machine 210 on worksite 300, the boundary of first zone 610, which is a static isolation zone, need not be redetermined. Further, the boundary of sub-zone 650 (that is a static isolation zone) of second zone 630 need not be redetermined. Only the new boundary of sub-zone 660 (that is a dynamic isolation zone), in which the location of cable 400 moves outside of the original boundary of the sub-zone, needs to be determined. As discussed above, the area of sub-zone 660 is minimized as the result of the area of sub-zone 650 being maximized.

FIG. 2C shows machine 210 having moved from the second digging location to a third digging or working location on worksite 300. When machine 210 moves a sufficient distance from a prior digging or working location to a subsequent location, it may eventually become necessary or desirable to relocate or redetermine the boundary of sub-zone 650 of second isolation zone 630, since cable 400 may no longer lie within sub-zone 650.

As shown in the figure, even as a result of movement of machine 210 on worksite 300, the boundary of first zone 610, which is a static isolation zone, still need not be redetermined. But, the boundary of sub-zone 650 of second zone 630 does need to be redetermined, as cable 400 is moved outside of the original boundary of sub-zone 650. Sub-zone 650 still remains a static isolation zone because after the new boundary of sub-zone 650 is determined, cable 400 does not move outside of the new boundary of sub-zone 650 even when machine 210 moves to another subsequent digging or working location that is adjacent to the third location. Sub-zone 660, however, remains a dynamic isolation zone, since cable 400 is expected to move outside of the new boundary of sub-zone 660 when machine 210 does move from the third location shown in FIG. 2C to the another subsequent digging location.

INDUSTRIAL APPLICABILITY

As discussed above, the disclosure describes multiple isolation zones, separated from one another, in which electric cable 400 lies on the ground to provide power from the power source (not shown) to machine 210. First isolation zone 610 may be a static isolation zone, in which cable 400 does not move as a result of movement of machine 210 from a first to a second working or digging location on worksite 300. Thus, even when machine 210 moves between adjacent digging locations on worksite 300, the boundary of first zone 610 does not change. As a result, visual markers indicating the boundary of first zone 610, in which cable 400 lies on the ground, do not need to be moved or repositioned. Coordinate locations indicating the boundary of first zone 610 also need not be redetermined, so that no updated information needs to be provided to either a driver-controlled vehicle, such as to operate an alarm if the driver drives into the first zone 610, and no updated information needs to be provided to an autonomously-controlled vehicle, such as to keep the vehicle from driving into first zone 610.

Second isolation zone 630, in contrast, may be at least in part a dynamic isolation zone, since movement of machine 210 from the first digging location to the second digging location on worksite 300 results in a movement of cable 400 outside of at least a portion of the original boundary of second zone 630. Thus, at least a portion of the boundary of second zone 630 must change in order for second zone 630 to continue to define an isolation zone that completely encompasses cable 400 between shovel-side pole 640 and machine 210. Because second zone 630 is a zone separate from first zone 610, as discussed above the boundary of first zone 610 need not be redetermined even when machine 210 moves between adjacent or relatively near digging locations.

In order to reduce costs, labor requirement, time delays, and other disadvantages associated with determining an entire boundary of second zone 630 when machine 210 moves on worksite 300, second zone 630 may be further divided into both a static isolation zone as well as a dynamic isolation zone. Sub-zone 650 may be a static isolation zone, defined between shovel-side pole 640 and anchor line 670, with anchor line 670 being defined so that movement of machine 210 from the first digging location to the second digging location on worksite 300 does not result in cable 400 moving outside of the boundary of sub-zone 650. Further, the location of anchor line 670 may be chosen so that the area of sub-zone 650 is maximized. Thus, visual markers indicating the boundary of sub-zone 650, in which cable 400 lies on the ground, do not need to be moved or repositioned, and coordinate locations indicating the boundary also need not be redetermined, so that no updated information needs to be provided to either a driver-controlled vehicle to operate an alarm if the driver drives into sub-zone 650, or to an autonomously-controlled vehicle to keep the vehicle from driving into sub-zone 650. Thus, one or more of the above-discussed disadvantages of related cable management systems are avoided.

Sub-zone 660 may be a dynamic isolation zone defined between anchor line 670 and machine 210. The aforementioned isolation zones and sub-zones may be arranged such that sub-zone 660 is the only zone outside of which cable 400 moves when machine 210 moves from the first digging location to the second digging location in worksite 300. Further, because the location of anchor line 670 is chosen to maximize the area of static isolation sub-zone 650, the area of dynamic isolation sub-zone 660 is minimized. Thus, the area of sub-zone 660, for which the boundary must be redetermined when machine 210 moves between adjacent digging locations on worksite 300, is minimized. The extent to which visual markers must be relocated and to which coordinate information must be redetermined is therefore also minimized.

In accordance with the disclosure, the location of electric cable 400 on worksite 300, and thus the determination of the boundaries of zones 610 and 630, may be managed as follows.

Nonshovel-side pole 620 and shovel-side pole 640 may be placed on worksite 300. Nonshovel-side pole 620 is placed nearer the power source (i.e., on a "nonshovel side" of the worksite 300), while shovel-side pole 640 is placed nearer machine 210 (i.e., on a "shovel side" of the worksite 300). Poles 620 and 640 may be disposed a sufficient distance from one another to permit worksite vehicles, such as vehicle 500, to pass therebetween. Absolute or relative positions of poles 620 and 640 may be determined and recorded, such as by using global positioning system coordinates, or by another method.

Cable 400 is run on the ground from the power source to nonshovel-side pole 620, and nonshovel-side pole 620 holds a portion of cable 400 off of the ground. The portion of cable 400 that is held off the ground is connected to shovel-side pole 640, such that cable 400 does not lay on the ground between poles 620 and 640. Cable 400 lies on the ground and is run from shovel-side pole 640 to machine 210, which is in a first digging or working location, such as is shown in FIG. 2A.

Visual markers, such as safety cones, fencing, etc., may be placed adjacent or around cable 400 from the power source to nonshovel-side pole 620, and from shovel-side pole 640 to machine 210.

The boundary is determined for each of first area 610 and second area 630. Absolute or relative positions of the boundaries may be determined, such as by using global positioning system coordinates, or any other method. For example, the boundary may be manually determined, for example by driving a vehicle around cable 400 and/or around the visual markers, and noting the location of the vehicle at set time or distance intervals, and/or in response to operations of a driver. Alternately or in conjunction with this procedure, the location of cable 400 may be determined in accordance with the disclosure of U.S. Pat. No. 7,793,442, which is incorporated by reference herein in its entirety. It is to be understood that either or both of first zone 610 and second zone 630 need not define a closed area. For example, especially in the case of first zone 610, the boundary of first zone 610 need not necessarily extend to the power source, which may be sufficiently far away from any expected digging locations of machine 210 such that any danger of a vehicle driving over cable 400 adjacent the power source is minimal.

The location of anchor line 670 is determined so that, based on the expected movement of cable 400 when machine 210 moves from its current digging location to an adjacent digging location (such as from the first digging location shown in FIG. 2A to the second digging location shown in FIG. 2B), the boundary of sub-zone 650 does not need to be redetermined while at the same time the area of sub-zone 660 is prevented from being too large and impeding efficient use of worksite 300, such as by taking up too much area of worksite 300 with the isolation zones. As discussed above, the location of anchor line 670 is determined so that the area of sub-zone 650, which is a static isolation zone, is maximized, and the area of sub-zone 660, which is a dynamic isolation zone, is minimized.

In accordance with the disclosure, the location of the two anchor points through which anchor line 670 runs may be determined by the operator of machine 210. Specifically, the operator of machine 210 may survey the two anchor points, which create the anchor line 670 that defines the ends of sub-zones 650 and 660. Surveying of one or both anchor points may be done by the operator of machine 210 relative to any point or points either on- or off-board machine 210, such as but not limited to one or more points at which earthmoving tool 270 is placed. After anchor line 670 is determined, based on the location of anchor line 670 and the location of machine 210, at least the area of the dynamic isolation sub-zone 660 may be determined by a computer on- or off-board of machine 210, which includes a processor, memory, and other hardware, running an algorithm. Specifically, the algorithm may determine an expected path of movement for cable 400 based on a location of a portion of cable 400 adjacent anchor line 670 and an expected movement of machine 210, and define an appropriately-sized area around this expected path of cable movement. By this process, the boundary of dynamic isolation sub-zone 660 may be automatically generated based on the location of machine 210 and the location of anchor line 670, while the boundaries of static first isolation zone 610 and static isolation sub-zone 650 of second isolation zone 630 may have been manually determined.

The algorithm may use one or more parameters or inputs to automatically generate the boundary or boundaries of one or more of the zones 610 or 630, or sub-zones 650 or 660, based on, for example, an expected path of cable 400. It is to be understood, however, that the specific use and implementation of the algorithm will be within the purview of one of ordinary skill in the art. By way of specific, non-limiting examples, the algorithm may use one or more of the following parameters or inputs: location of machine 210; expected subsequent location of machine 210; location of anchor line 670; expected subsequent location of anchor line 670; location(s) of one or both anchor points; expected subsequent location of one or both anchor points; overall length of cable 400; length of cable 400 within sub-zone 660; length of cable within second isolation zone 630; location of a portion of cable 400 relative to one or more anchor points and/or anchor line 670; expected subsequent location of a portion of cable 400 relative to one or more anchor points and/or anchor line 670; current and/or expected subsequent tautness of cable 400, at current and/or expected subsequent location of machine 210; expected movement of cable 400 when machine 210 moves from current location to expected subsequent location; and/or another characteristic of cable 400. It is to be understood, however, that one or more other parameters or inputs, with or without one or more of the above-presented exemplary parameters or inputs, may be used by the algorithm to automatically generate the boundary or boundaries of one or more of the zones 610 or 630, or sub-zones 650 or 660. It is to be further understood that one or more other parameters or inputs, with or without one or more of the above-presented exemplary parameters or inputs, may be used to automatically generate an expected envelope in which cable 400 is expected to move when machine 210 moves from a current location to an expected subsequent location. The expected envelope may then be enlarged to provide an additional factor of safety, thereby automatically generating the boundary or boundaries of one or more of the zones 610 or 630, or sub-zones 650 or 660.

When machine 210 moves from one digging location to another digging location, such as from the first position in FIG. 2A to the second position in FIG. 2B, only the boundary of dynamic isolation sub-zone 660 may need to be redetermined. The boundaries of first zone 610 and sub-zone 650 of second zone 630 may not need to be redetermined. Absolute or relative positions of the new location of the boundary of sub-zone 660 may be determined, such as by using global positioning system coordinates, or any other method. For example, the boundary of dynamic isolation sub-zone 660 may be manually determined by driving a vehicle around cable 400 and the location of the vehicle may be noted at set time or distance intervals, and/or the location of the vehicle may be noted in response to operations of a driver.

In accordance with the disclosure, the boundary of dynamic isolation sub-zone 660 may be automatically generated. The location of the two anchor points through which anchor line 670 runs, as determined by the operator of machine 210 when machine 210 was in the first position shown in FIG. 2A, may still be used to define the ends of sub-zones 650 and 660. Based on the unchanged-location of anchor line 670 and the new location of machine 210, the area of the dynamic isolation sub-zone 660 may be redetermined, such as by the computer on- or off-board of machine 210. The boundaries of static first isolation zone 610 and static isolation sub-zone 650 of second isolation zone 630 may not change and may not need to be redetermined.

When machine 210 moves from the second digging location, such as is shown in FIG. 2B, to the third digging location, such as shown in FIG. 2C, it may be necessary or desirable to relocate or redetermine the boundary of sub-zone 650 of second isolation zone 630, even though the boundary of first zone 610 need not be redetermined. It may also be necessary or desirable to relocate or redetermine the boundary of sub-zone 660 of second isolation zone 630. Absolute or relative positions of the new locations of the boundaries of either or both of static sub-zone 650 and dynamic sub-zone 660 may be determined, such as by using global positioning system coordinates, or any other method. For example, the boundary of sub-zones 650 and/or 660 may be manually determined by driving a vehicle around cable 400 and the location of the vehicle may be noted at set time or distance intervals, and/or the location of the vehicle may be noted in response to operations of a driver.

In accordance with the disclosure, the boundaries of either or both of static isolation sub-zone 650 and dynamic isolation sub-zone 660 may also be automatically generated. The location of shovel-side pole 620 may still be used to define the end of sub-zone 650. Further, the new location for the two anchor points through which anchor line 670 runs may be determined by the operator of machine 210. Specifically, the operator of machine 210 may survey the two new anchor points, which create the new location for anchor line 670 that defines the ends of sub-zones 650 and 660. Based on both the determination of the new position of anchor line 670 and the unchanged location of shovel-side pole 620, the new boundary of the static isolation sub-zone 650 may be determined by the computer on- or off-board of machine 210. Further, or in the alternative, the new location of anchor line 670 and the new location of machine 210 may be used to determine the new boundary of the dynamic isolation sub-zone 660. By this process, the boundary of static isolation sub-zone 650 and the boundary of dynamic isolation sub-zone 660 may be automatically generated or redetermined, such as by the use of the above-discussed algorithm, while the boundary of static first isolation zone 610 may remain the same and may not need to be redetermined. Upon subsequent movement of machine 210 to an adjacent position, the boundaries of first zone 610 and static sub-zone 650 may not change and may not need to be redetermined, but only the boundary of dynamic sub-zone 660 may change and may need to be redetermined.

Aspects of the disclosure, such as the above-discussed determination of boundaries of isolation zone 630 and/or sub-zones 650 or 660, may be stored on a tangible, computer-readable storage medium. The medium may store a program that when executed by a processor of a computer, such as a computer on- or off-board of machine 210, manages locations of cable 400 between or among movements of machine 210.

What is claimed is:

1. A method of managing movement of an electric cable that is configured to provide power to a mobile machine, the method comprising:

determining an initial boundary of an isolation zone in which the cable lies, for a first location of the machine;

dividing the initial boundary into a first static boundary and a first dynamic boundary, the first static boundary surrounding a static isolation sub-zone of the isolation zone, and the first dynamic boundary surrounding a dynamic isolation sub-zone of the isolation zone;

determining, with a processor, a second dynamic boundary surrounding the dynamic isolation sub-zone, based on a second location of the machine when the machine moves from the first location to the second location, such that the cable lies within the second dynamic boundary; and maintaining the first static boundary when the machine is in the second location, the cable configured to move within the first static boundary.

2. The method according to claim 1, wherein determining the initial boundary of the isolation zone comprises manually determining the initial boundary of the isolation zone.

3. The method according to claim 1, wherein dividing the initial boundary comprises determining a location of an anchor line that divides the initial boundary into the first static boundary and the first dynamic boundary.

4. The method according to claim 3, wherein determining the location of the anchor line comprises determining the location of the anchor line to maximize an area defined by the first static boundary.

5. The method according to claim 4, wherein determining the location of the anchor line comprises having an operator of the machine determine the location of the anchor line.

6. The method according to claim 3, further comprising:

determining an updated location of the anchor line when the machine moves from the second location to a third location; and determining, when the machine is in the third location, a second static boundary that surrounds the static isolation sub-zone, such that the cable lies within the second static boundary, the second static boundary being based on the updated location of the anchor line.

7. The method according to claim 6, further comprising:

determining, when the machine is in the third location, a third dynamic boundary that surrounds the dynamic isolation sub-zone, such that the cable lies within the third dynamic boundary, the third dynamic boundary being based on the updated location of the anchor line.

8. The method according to claim 7, wherein determining the updated location of the anchor line comprises determining the updated location of the anchor line to maximize an area defined by the second static boundary.

9. The method according to claim 1, wherein the machine is disposed within the first dynamic boundary when the machine is in the first location and is disposed within the second dynamic boundary when the machine is in the second location.

10. The method according to claim 1, further comprising:

determining a third dynamic boundary surrounding the dynamic isolation sub-zone, based on a third location of the machine when the machine moves from the second location to the third location, such that the cable lies within the third dynamic boundary.

11. A method of managing movement of an electric cable that is configured to provide power to a mobile machine, comprising:

determining a boundary of a power-side isolation zone in which the cable extends from a power source to a first pole;

determining a boundary of a machine-side isolation zone in which the cable extends from a second pole to the machine;

determining a location of an anchor line that divides the boundary of the machine-side isolation zone into a first static boundary and a first dynamic boundary, the first static boundary surrounding a static isolation sub-zone of the isolation zone, and the first dynamic boundary surrounding a dynamic isolation sub-zone of the isolation zone;

determining, with a processor, a second dynamic boundary surrounding the dynamic isolation sub-zone, based on the location on the anchor line and on a second location of the machine when the machine moves to the second location, such that the cable lies within the second dynamic boundary; and maintaining the first static boundary when the machine is in the second location, the cable lying within the first static boundary, and a portion of the cable adjacent the anchor line laterally movable within the first static boundary as the machine moves from the first location to the second location.

12. The method according to claim 11, wherein the electric cable lies on the ground in a portion of each of the power-side and machine-side isolation zones.

13. The method according to claim 11, wherein determining the location of the anchor line comprises determining the location of the anchor line to maximize an area defined by the first static boundary.

14. The method according to claim 11, wherein the machine is disposed within the first dynamic boundary when the machine is in the first location.

15. The method according to claim 11, further comprising:

determining a third dynamic boundary surrounding the dynamic isolation sub-zone, based on a third location of the machine, such that the cable lays within the third dynamic boundary.

16. The method according to claim 11, further comprising:

transmitting coordinates of at least one of the boundaries to an autonomous vehicle.

17. The method according to claim 16, further comprising:

operating an alarm in the vehicle when the vehicle enters the at least one of the boundaries defined by the transmitted coordinates.

18. The method according to claim 11, further comprising:

running the cable from the power source to the first pole, such that at least a portion of the cable lies on the ground therebetween;

running the cable from the first pole to the second pole, such that the cable is off the ground between the first and second poles; and running the cable from the second pole to the machine, such that a least a portion of the cable lies on the ground therebetween.

19. A tangible, computer-readable storage medium storing a program that, when executed by a processor of a computer, performs a method of managing movement of an electric cable that is configured to provide power to a mobile machine, the method comprising:

determining an initial boundary of an isolation zone in which the cable lies, for a first location of the machine;

determining a location of an anchor line that divides the initial boundary into a first static boundary and a first dynamic boundary, the first static boundary surrounding a static isolation sub-zone of the isolation zone, and the first dynamic boundary surrounding a dynamic isolation sub-zone of the isolation zone;

determining a second dynamic boundary surrounding the dynamic isolation sub-zone, based on the location on the anchor line and on a second location of the machine when the machine moves from the first location to the second location, such that the cable lies within the second dynamic boundary; and maintaining the first static boundary when the machine is in the second location, the cable lying within the first static boundary, and a portion of the cable laterally movable within the first static boundary as the machine moves from the first location to the second location.

20. The tangible, computer-readable storage medium storing a program that, when executed by a processor of a computer, performs a method of managing movement of an electric cable that is configured to provide power to a mobile machine, according to claim 19, the method further comprising:

determining a third dynamic boundary surrounding the dynamic isolation sub-zone, based on a third location of the machine when the machine moves to the third location, such that the cable lies within the third dynamic boundary.

* * * * *